United States Patent [19]

Zupancic et al.

[11] 4,317,634

[45] Mar. 2, 1982

[54] MACHINE

[76] Inventors: Viktor Zupancic, Cesta v gorice 10/D, 61000 Ljubljana; Joze Miklavcic, Oslica 13, 61295 Ivancna gorica, both of Yugoslavia

[21] Appl. No.: 66,540

[22] Filed: Aug. 15, 1979

[30] Foreign Application Priority Data

Aug. 18, 1978 [YU] Yugoslavia ..... 1978/78

[51] Int. Cl.[3] ..... B28C 5/00; B66D 1/26

[52] U.S. Cl. ..... 366/1; 254/299

[58] Field of Search ..... 254/299; 366/1, 2, 3, 366/4, 5, 6

[56] References Cited

U.S. PATENT DOCUMENTS

| | | | |
|---|---|---|---|
| 2,112,326 | 3/1938 | Berner | 366/1 |
| 2,256,484 | 9/1941 | Kemp | 366/1 |
| 2,406,335 | 8/1946 | Kuert | 366/1 X |
| 3,614,066 | 10/1971 | Day | 254/299 |
| 3,785,504 | 1/1974 | Cheldelin | 254/299 |
| 3,788,606 | 1/1974 | Solter | 254/299 X |

*Primary Examiner*—Edward J. McCarthy

*Attorney, Agent, or Firm*—Morgan, Finnegan, Pine, Foley & Lee

[57] ABSTRACT

In a machine comprising a plurality of driven working implements, at least one common main drive is provided, which has a main drive shaft, from which at least some of the working implements are driven directly through the intermediary of non-positive clutches associated with the respective working implements. Such machine can be operated in an energy-saving and ecologically satisfactory manner and also permits a saving of material and nevertheless can be used for a large number of purposes and to perform a plurality of operations often required in specific fields of application.

28 Claims, 11 Drawing Figures

Figure 1:
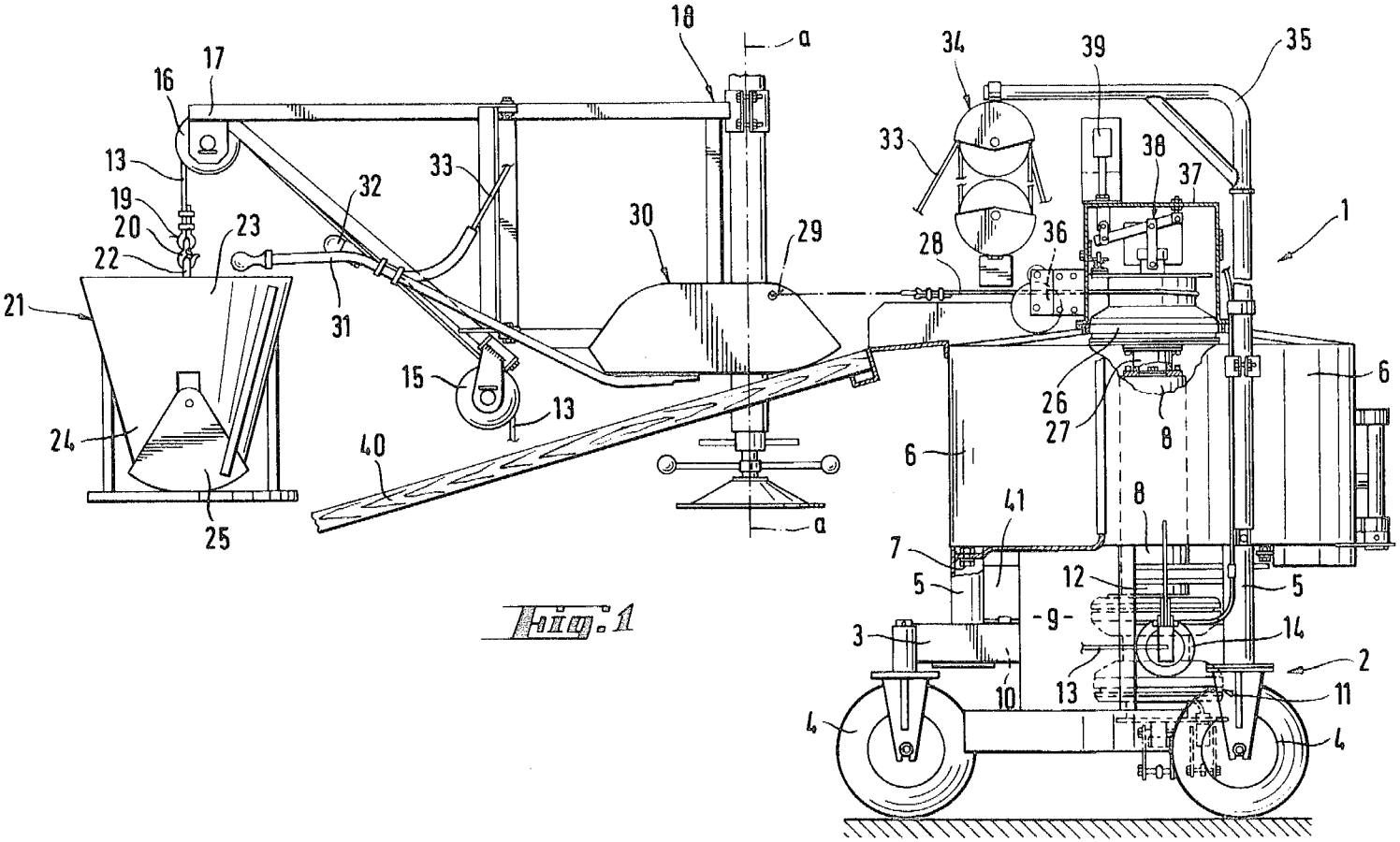

129
92
130
126
125
128
127
131
131
124
123
122
121
120

MACHINE

This invention relates generally to machines provided with a plurality of driven working implements.

Various types of machines are used, e.g., in the construction trade, in forestry, in agriculture and generally for handling materialy in loading, reloading and unloading operations. Most of these machines are intended and designed for a specific field of application so that it is often necessary in these fields of application to use a large number of self-contained machines to perform a sequence of operations. As each of these self-contained machines has a separate prime mover, such as an electric motor or an internal combustion machine, the prime movers of several machines must be operated independently of each other when a plurality of such machines are used in combination. As a result, the power required to perform the operations is multiplied. The use of entirely self-contained machines necessitates also a large number of duplicate components and subassemblies, and the manufacture of such components and subassemblies is expensive and involves a consumption of raw materials, which are becoming short in supply. The practice which has been outlined is also ecologically unsatisfactory, particularly where internal combustion engines are used.

In order to eliminate or reduce these difficulties and disadvantages, it is an object of the present invention to provide a machine which comprises a plurality of driven working implements and which can be operated in an energy-saving and ecologically satisfactory manner and also permits a saving of material and nevertheless can be used for a large number of purposes and to perform a plurality of operations often required in specific fields of application. Specifically, the machine is to be designed so that there is provision for a connection of additional driven working implements, which are not included in the basic arrangement of the machine. Besides, the machine should have a long life and be as compact as possible.

A machine comprising a plurality of driven working implements is characterized according to the invention by the provision of at least one common main drive having a main drive shaft, from which at least some of the working implements are driven directly through the intermediary of non-positive clutches associated with the respective working implements.

It is apparent that the machine according to the invention comprises a common main drive, which supplies the power for operating almost all driven working implements associated with the machine. As a result, the energy consumption of such machine can be reduced because a single main prime mover can be used to perform a plurality of operations at the same time or in a predetermined timed relation. Because the invention provides a common prime mover so that duplicate components and subassemblies are not required, much less materials are required than in the previous designs. As a non-positive clutch is associated with each working implement, these implements may be selectively operated independently of each other or in combination. When, e.g., a given implement is not required at all in certain operations, that implement will not consume driving power so that no energy is lost or wasted. The machine designed according to the invention has a wide field of applicaton. A basic model may be provided and can be set up for a given purpose merely by an adaptation of the means for connection to the working implements without need for a structural alteration. Because the machine according to the invention may be assembled from prefabricated modules, the several components and subassemblies of the machine can be made at low cost in large quantities or in mass production. As a result, the entire machine according to the invention can be manufactured at relatively low cost. The design may be such that those components of the machine which are liable to be deranged or susceptible to being soiled are protected by a surrounding housing so that trouble in the operation of the machine need not be expected even in rough usage. In addition to this improved reliability in operation, the machine according to the invention can easily be serviced because the components that are liable to be deranged are readily accessible and the reduction of the number of components and subassemblies reduces the number of parts which are liable to be deranged and must be inspected.

Those working implements of the machine according to the invention which must operate at the same speed as the main drive shaft can be connected to the latter without difficulty by means of a connecting shaft which is non-rotatably connected to the main drive shaft and cooperates with the associated non-positive clutch.

If optional working implements must be driven at a speed which differs from and is, e.g., lower than that of the main drive shaft, a speed-reducing transmission may be provided, which is coupled to the main drive shaft and has an output shaft for driving additional working implements at reduced speed.

The combinations which can be obtained in this way permit a driving of working implements at different speeds from a common main prime mover so that the machine according to the invention has a very wide field of application.

The connections and clutches between the main drive shaft and the output shaft, on the one hand, and the several working implements, on the other hand, should be as uniform as possible. To that end, the coupling means provided for that purpose constitute almost identical components. The coupling means comprise preferably a V-belt pulley as a power-transmitting means and a chain sprocket. It will be understood that the two coupling means may be provided at different points of the main drive shaft of the main prime mover and/or the output shaft of the speed-reducing transmission. This arrangement may be selected in view of the intended use.

The non-positive clutch associated with each working implement of the machine according to the invention is preferably controlled by at least one control rope, which preferably cooperates with a control linkage, which can be actuated manually and/or mechanically and/or electrically. The mode of actuation of that linkage will be selected in dependence on the mode of operation of the machine and on the purpose for which it is intended. For instance, in a machine in which the main prime mover consists of an electric motor, the control linkage connected to the control rope will preferably be electrically operated. It will be understood that combined electromechanical actuating means may also be adopted.

At least some and preferably all of the working implements consist of rope winches, which are preferred as working implements because they are rugged and durable and can take up and transmit strong working forces. Besides, rope winches and traction ropes connected to them may be used to perform almost all working operations which can be conceived because the traction ropes trained around guiding and deflecting rope pulleys can be used to transmit power over large distances almost without loss. Such traction ropes may be used not only to transmit power to means for handling materials, such as lifting tackle, but also to switch and to initiate the operation of remote subassemblies and several actuating elements. The length of the traction rope can actually be freely selected almost without restriction.

The non-positive clutch preferably comprises a drum-shaped housing, which forms a lateral confining surface, which protrudes radially beyond the rope-winding core, which is mounted on a hub, which is mounted on the connecting shaft, and the latter is fixed to the drum-shaped housing of the non-positive clutch. A rope-winding core as well as lateral confining surfaces are anyway required in a rope winch for a satisfactory guidance of the rope and the above-mentioned design of the rope winch within the scope of the invention ensures that the non-positive clutch provides one of the lateral confining surfaces. In numerous applications, an additional brake is not required for the rope winch. In that case the lateral confining surface on that side of the rope-winding core which is opposite to the clutch is preferably formed by a flange, which is fixed to the rope-winding core. The control rope connected to the control linkage may then be secured to that side of the flange which is remote from the rope-winding core. In that case, the control rope extends through the interior of the rope winch and through the drum-shaped housing to the non-positive clutch.

If the rope winch is used, e.g., in conjunction with a traction rope for means for handling material, such as a crane used as a lifting tackle or an elevator, and for this purpose requires a brake, the second lateral confining surface, which is opposite to the first confining surface which radially protrudes beyond the rope-winding core may also be formed by a drum-shaped housing, which accommodates a controlled brake for the rope winch, and the rope-winding core may consist of an annular member that is disposed between and secured to the two drum-shaped housings. In that preferred embodiment, the non-positive clutch and/or the brake for the rope winch ensure a reliable guidance of the traction rope without need for separate lateral confining surfaces associated with the rope-winding core.

A control rope is preferably used also to apply the brake and cooperates with another control linkage, which can also be actuated manually and/or mechanically and/or electrically.

In an embodiment in which a clutch and a controlled brake are associated with a driven working implement consisting of a rope winch, a compact mounting can be achieved if the control linkages are mounted on a common carrying plate, which is secured to one of the two drum-shaped housings on that side which is remote from the rope-winding core.

In a machine according to the invention intended for use in forestry, the rope winch consists preferably of a traction rope winch, which in that case serves directly to handle materials. Such traction rope winch is preferably combined with a speed-reducing transmission, which is coupled to the main drive shaft driven by the engine of the vehicle, and additional working implements can be connected to the output shaft of the transmission. To provide for the largest possible field of application, two traction rope winches are preferably connected to the main drive shaft on opposite sides of the speed-reducing transmission. Because the respective non-positive clutches are associated with the two traction rope winches and can be controlled independently of each other, the two traction rope winches may be used for different operations independently of each other.

Another important field of application of the machine according to the invention is the construction trade. In that field, the machine according to the invention may be used with special advantage as a mixer for building materials. The mixing means of the mixer may be driven directly from the main drive shaft or from the speed-reducing transmission. This will depend mainly on the cubic capacity of the mixing vessel. To facilitate the work, plants for mixing building materials are often provided with charging buckets and/or with an elevator in a shaft and/or a slewing crane as additional means for handling materials. Previously, a separate prime mover was provided for each means for handling material. This involves several disadvantages, as has been stated hereinbefore. If rope winches are used within the scope of the invention as working implements, the working implements of such machine for mixing building materials may be driven by a common main prime mover. Because, e.g., the charging bucket must be pulled only during its working stroke toward the mixing vessel of the machine for mixing building materials and the power applied to return the charging bucket should be minimized, the working implement associated with the charging bucket may consist of a rope winch with which only a non-positive clutch but no brake is associated. Alternatively, a separate, additional prime mover may be used to drive the rope winch, if required. In that case the non-positive clutch and a belt drive are coupled to the output shaft of said additional prime mover so that additional driven working implements can be connected to that additional prime mover when this is required.

If a machine for mixing building materials comprises a rope winch for operating means for handling material, such as an elevator in a shaft or a slewing crane, a controlled brake as well as the non-positive clutch will be associated with the rope winch so that the means for handling material can be stopped and braked in desired positions. A permanently acting brake may also be provided if the materials-containing vessel of the means for handling material has a high capacity so that strong forces are applied to the traction rope of the rope winch when that vessel is filled. Even though such mixing machine comprises a plurality of working implements, the machine may be highly compact if the working implement consisting of the rope winch is axially aligned with the main drive shaft and the latter is vertical and centrally disposed with respect to the mixing vessel. To ensure a high stability, the working implements are disposed symmetrically to the mixing vessel and the main drive shaft. In that arrangement, only relatively short connecting shafts are required to connect the working implements consisting of rope winches to the main drive shaft so that the assembly consisting of the main drive shaft and the connecting shafts has almost the same inherent stiffness as a continuous shaft.

The main prime movers of the machines according to the invention consist preferably of internal combustion engines or electric motors.

Each non-positive clutch of the machine according to the invention consists preferably of a friction clutch. Those surfaces of the cooperating components which are in frictional contact may be formed by discs. If the housing of the non-positive clutch is drum-shaped, within the scope of the invention, the surfaces which are in frictional contact will be accommodated in and protected by the housing. In that case the surfaces which are in frictional contact may be so large that even strong forces can be transmitted from the drive shaft to the working implements.

The use of a non-positive clutch consisting of a friction clutch affords also the advantage that the main prime mover cannot be overloaded because the friction clutch will automatically slip under excessively strong forces so that the latter cannot be transmitted to the main prime mover. Such friction clutch thus provides a protection against overloading.

Figure 2:
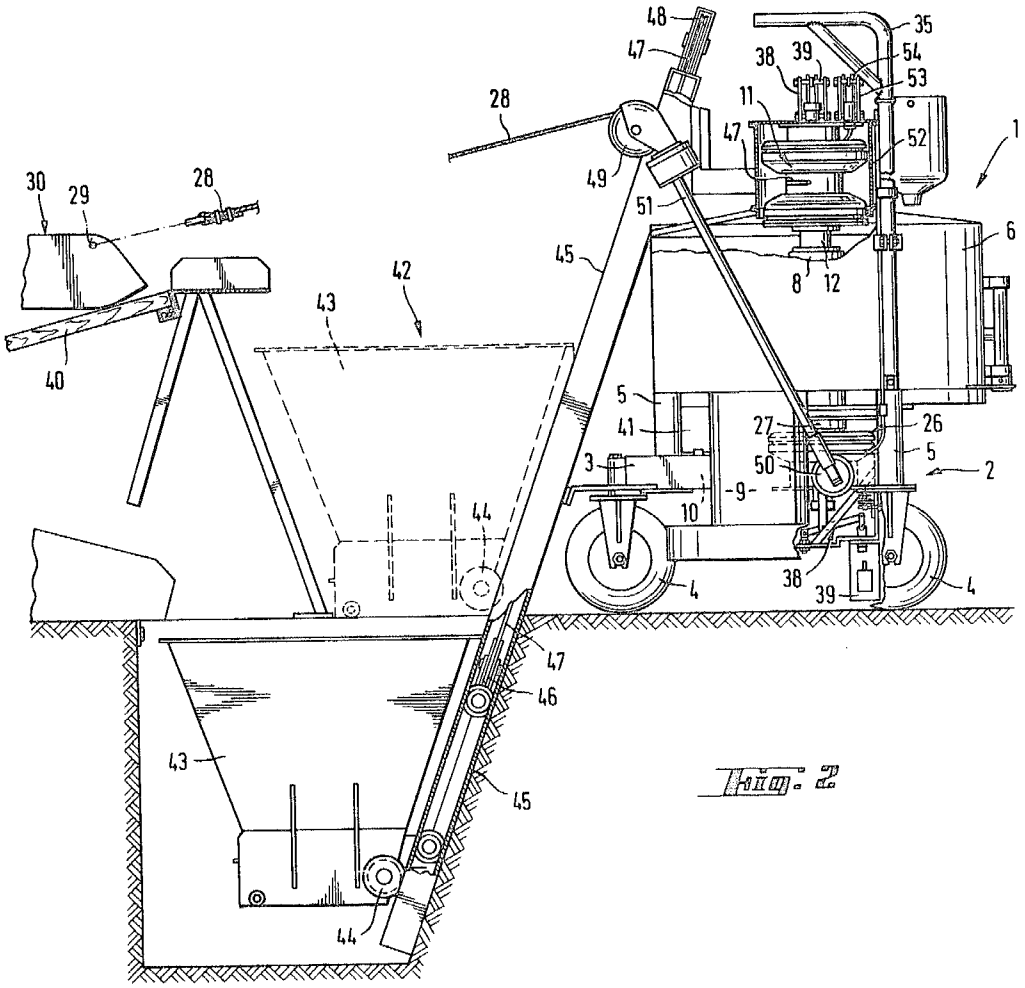
Figure 3:
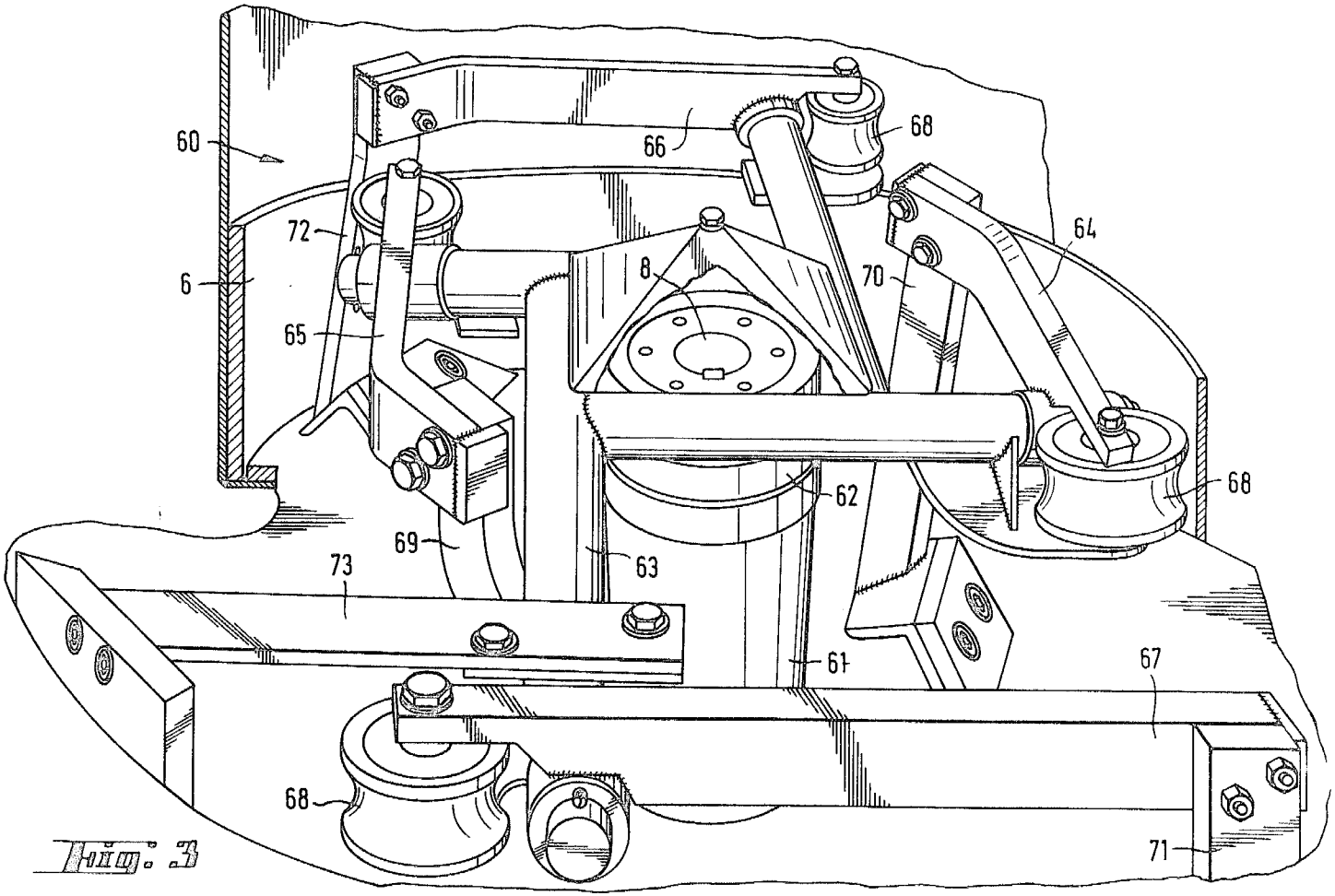
Figure 4:
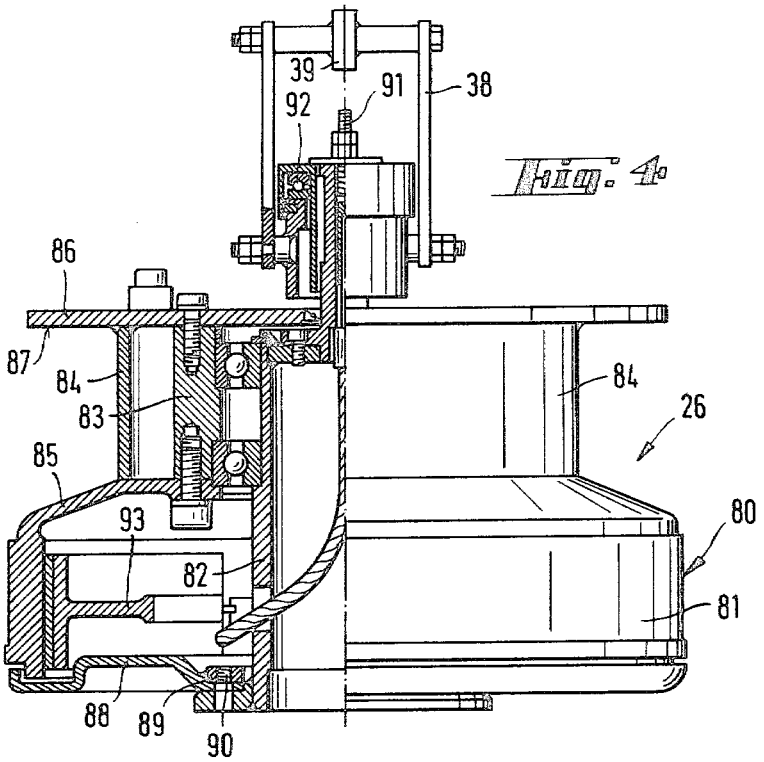
Figure 5:
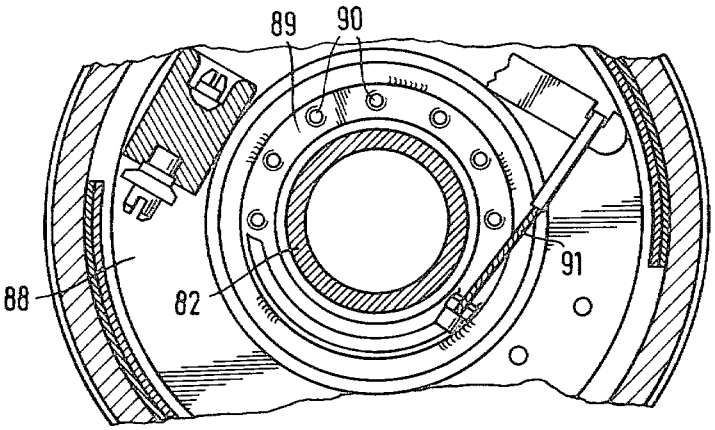
Figure 6:
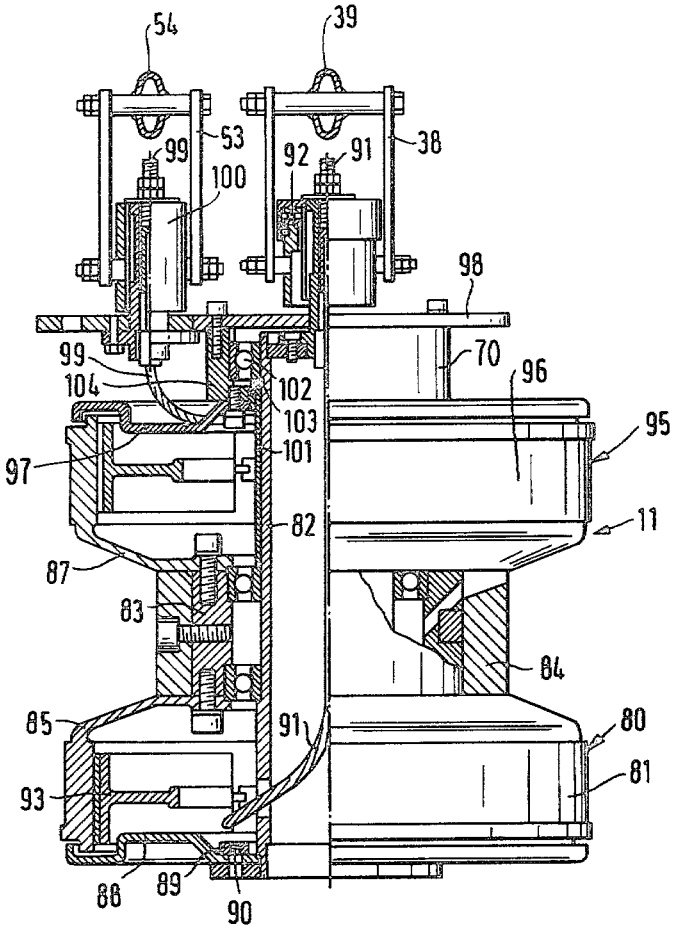
Figure 7:
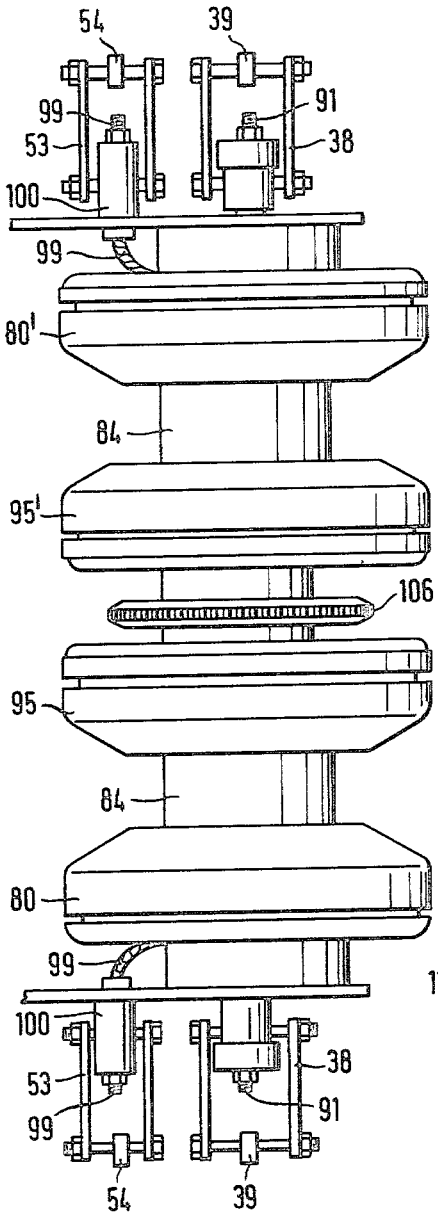
Figure 8:
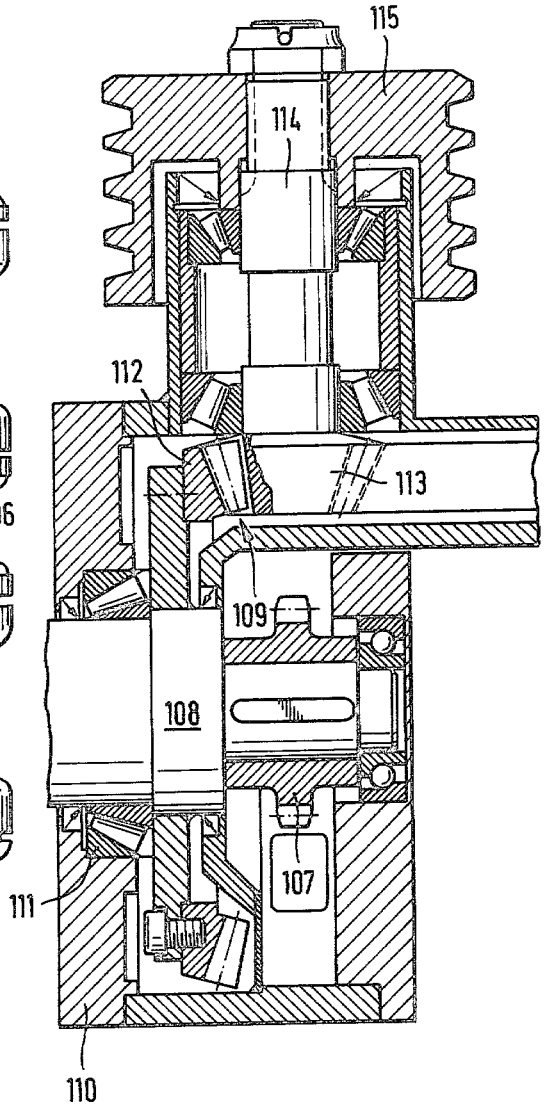
Figure 4:
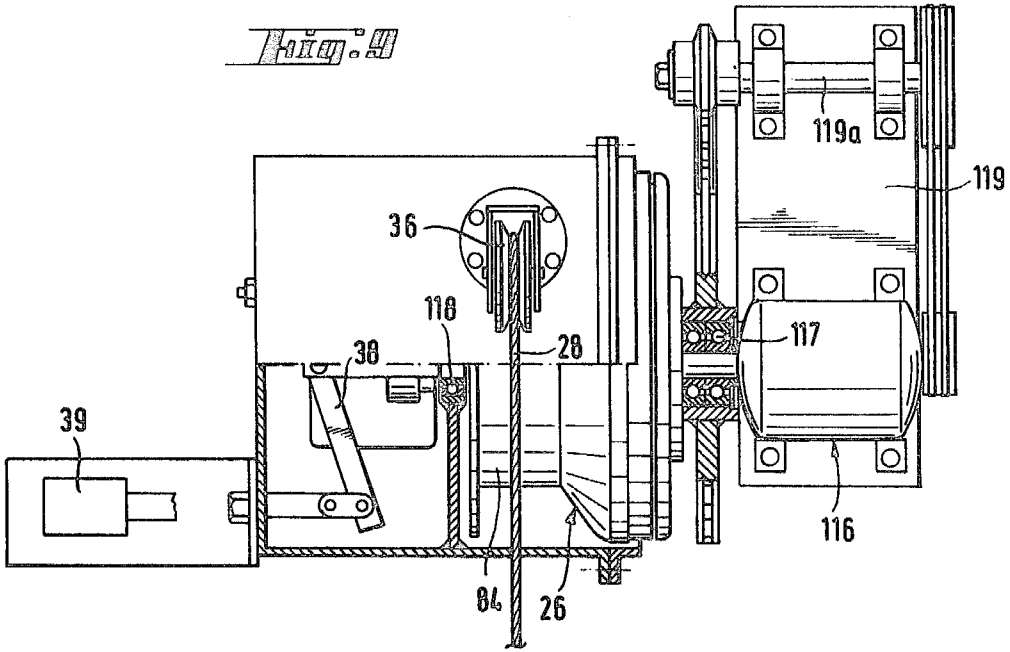
Figure 10:
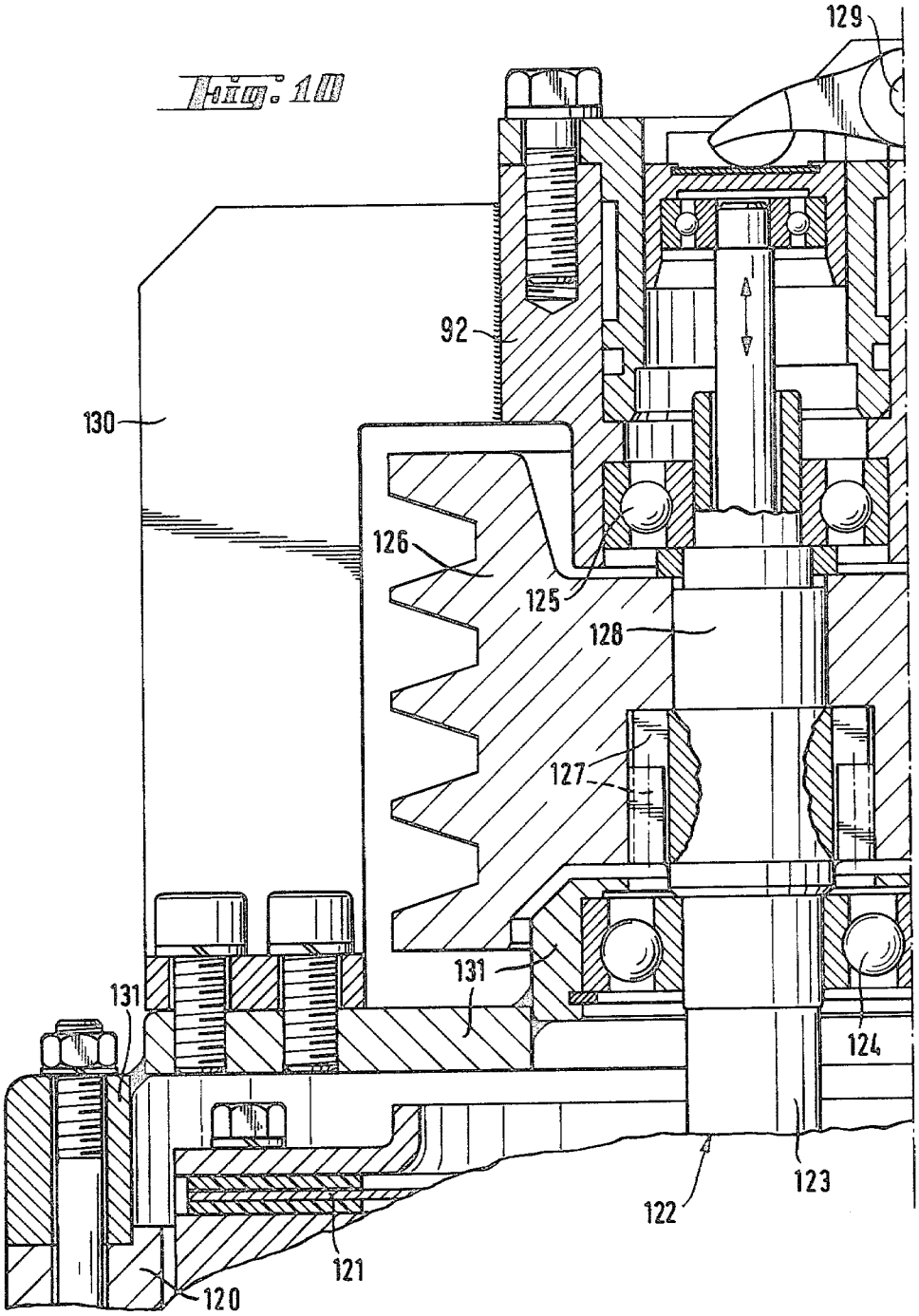
Figure 11:
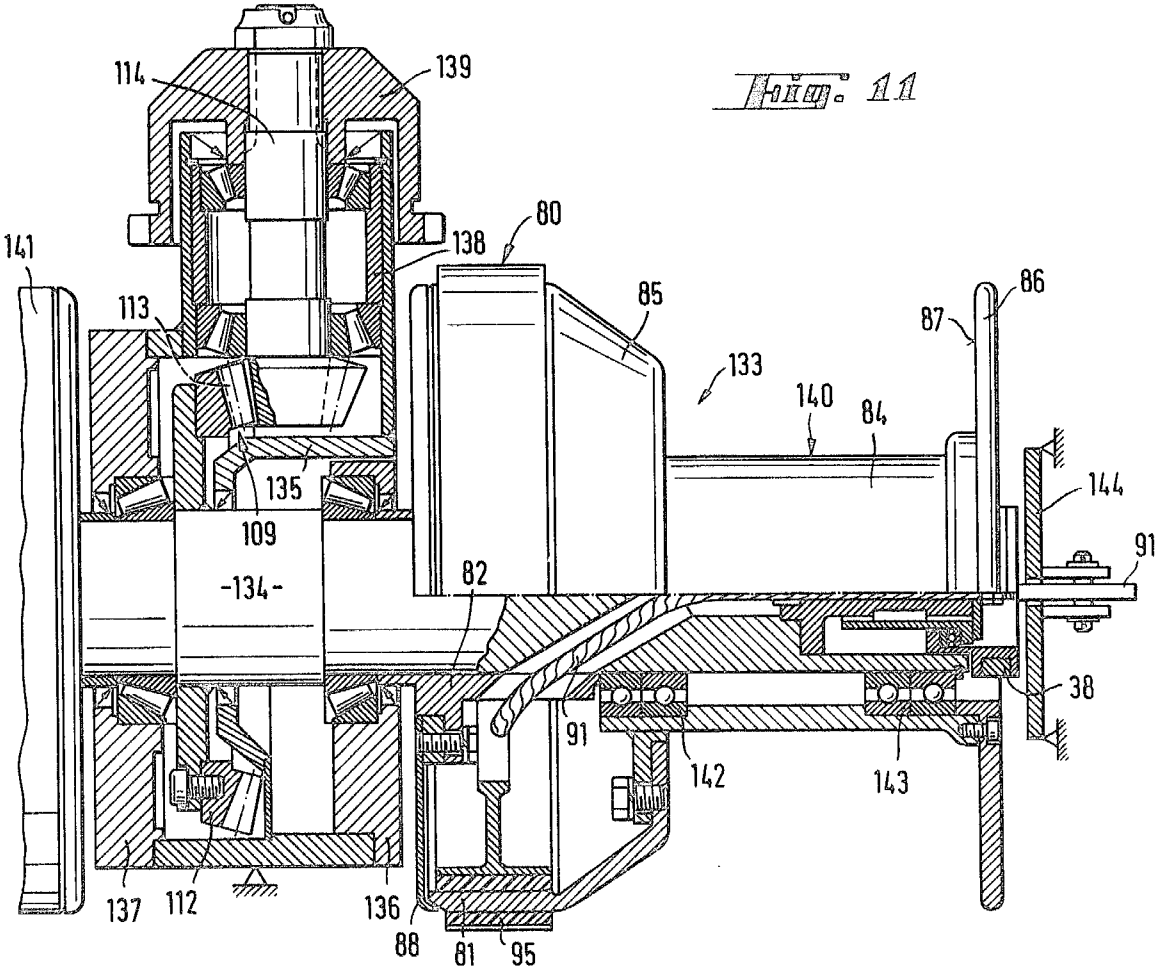

Further details and advantages of the invention will become apparent from the following description of illustrative embodiments with reference to the accompanying drawings, in which FIG. 1 is a diagrammatic side elevation showing a machine for mixing building materials as a first embodiment of the invention, FIG. 2 is a diagrammatical side elevation showing another embodiment of a machine for mixing building materials according to the invention, FIG. 3 is a diagrammatic perspective view showing the mixing means of a machine for mixing building materials in accordance with FIG. 1 or 2, FIG. 4 is a side elevation, partly in section, showing a rope winch as a working implement of a machine according to the invention, FIG. 5 is a bottom view showing the rope winch of FIG. 4, FIG. 6 is a side elevation, partly in section, showing a rope winch used in a machine according to the invention as a working implement and provided with a brake, FIG. 7 is a side elevation showing a connection between brakes associated with respective working implements consisting of rope winches, and means for a connection to an additional working implement, FIG. 8 is a vertical sectional view showing an embodiment of a speed-reducing transmission with means for connection to additional working implements in a machine for mixing building materials according to FIGS. 1 and 2, FIG. 9 is a diagrammatic side elevation, partly in section, showing a separate prime mover for connection to a working implement of the machine shown in FIGS. 1 and 2, FIG. 10 shows means for transmitting driving power to a traction rope winch for use in forestry in another embodiment of a machine according to the invention and FIG. 11 is a side elevation showing a traction rope winch for use in forestry.

In FIG. 1, a first embodiment of the invention is shown as a machine 1 for mixing building materials. The machine comprises a chassis 2, which is preferably provided with a triangular carrying frame 3, which is supported by wheels 4 on the ground. Preferably three columns, which are semi-circular in cross-section, are secured to the top of the carrying frame 3 of the chassis 2. A drumlike mixing vessel 6 is secured by screws 7 to the columns 5. A main drive shaft 8 is centrally disposed with respect to the mixing vessel and extends through the latter and is connected to a main prime mover 9. As is diagrammatically indicated in FIG. 1, a speed-reducing transmission can be coupled to the main prime mover 9.

As is indicated in dotted lines in FIG. 1, a working implement consisting of a first rope winch 11 is disposed in alignment with the main drive shaft 8 below the mixing vessel 6 in the space between the bottom of the mixing vessel 6 and the carrying frame 3 and is provided with a brake. By means of a connecting shaft 12, the rope winch 11 is non-rotatably connected to the main drive shaft 8. A traction rope 13 is secured to the rope winch 11 and is trained over a plurality of guiding and deflecting rope pulleys and is finally trained around a rope pulley 16 at the protruding end 17 of a crane structure 18. The crane structure 18 consists preferably of a slewing crane and has an axis of rotation -a-. A crane hook 20 is secured to the free end 19 of the traction rope 13 and engages an eyelet 22 provided at the top of a load-carrying container 21. The load-carrying container 21 has an upper portion 23, which is approximately circular in cross-section, and a lower portion 24, which is formed with flats or oval in cross-section. A hinged shutter 25 is mounted on the lower portion 24 of the container 21.

Another working implement consisting of a second rope winch is disposed above the mixing vessel 6 and axially aligned with the main drive shaft 8. The rope winch 26 has no brake. It is also non-rotatably connected to the main drive shaft 8 by a connecting shaft 27. A traction rope 28 is secured to the second rope winch 26 and at its other end 29 is secured to a charging bucket 30. The latter comprises holding and guiding arms 31. A switch 32 is mounted on one of the guiding and holding arms 31 and is connected by an electric lead to a power source. The electric lead extends over a lifting block 34, which serves as an automatic winder and unwinder. The lifting block is mounted on the protruding end of an L-shaped top bracket 35, which is firmly connected to the carrying frame 3 and/or the columns 5. A rope pulley 36 mounted on the machine 1 for mixing building materials may be used to guide the traction rope 28 of the second rope winch 26. A boxlike housing 37 is disposed over the second rope winch 26 and accommodates and protects a control linkage 38 and an actuating element 39. A charging bucket 30 is slidable on an inclined surface 40 and during its movement toward the machine 1 for mixing building materials charges a building material into the mixing vessel 6.

In FIG. 2, a machine for mixing building materials as a second embodiment of the invention is also designated 1, and identical or similar components are designated with the same reference characters. The machine 1 for mixing building materials which is shown in FIG. 2 differs from the machine of FIG. 1 in that the crane structure 18 is replaced by an elevator 42 in a shaft. A load-carrying container 43 is carried by wheels 44 running on guide rails 45, which are inclined from the horizontal. A traction rope 47 of the elevator 42 is trained around a rope pulley 46, which is mounted on the container 43 in a fixed position. One end of the traction rope 47 is secured to the guide frame of the elevator 22 by means not shown in detail. The guide frame of the elevator 22 consists of guide rails 45. From that fixed end of the traction rope 47, the latter is trained around the rope pulley 47 and over a guiding and deflecting rope pulley 48, which is mounted at the top end of the guide frame of the elevator 42. At its other end, the traction rope 47 is secured to a working implement consisting of a rope winch 11, which is provided with a brake. In the embodiment shown in FIG. 2, the rope winch 11 provided with a brake is disposed above the mixing vessel 6 and axially aligned with the main drive shaft 8 and is non-rotatably connected to the main drive shaft by a connecting shaft 12.

Another working implement consists of a second rope winch 26, which has no brake and is accommodated under the mixing vessel 6 in the space between the bottom of the mixing vessel 6 and the carrying frame 3. A traction rope 28 is secured at one end to the second rope winch 26 and at the other end to a charging bucket 30. In the embodiment shown in FIG. 2, the traction rope 28 is guided and deflected by two rope pulleys 49 and 50. The traction rope 28 extends through the bore of a tubular rod 51, by which the rope pulleys 49 and 50 are interconnected, so that the traction rope 26 is protected by the rod 51. The latter is pivoted to the carrying frame 3 so that the rod 51 together with the rope pulley 49 can be pivotally moved laterally from the mixing vessel 6 of the machine 1 for mixing building material. This may be required to ensure that the traction rope 28 connected to the charging bucket 30 does not intersect the path of the elevator 42 and its container 43 so that the traction rope 28 will not interfere with the operation of the elevator 42 and that the elevator 42 will not interfere with the operation of the charging bucket 30.

In the embodiment shown in FIG. 2 the rope winch 11 provided with a brake is accommodated in and protected by a surrounding housing 52, which is provided at its top with the control linkage 53 and the actuating element 54 for the rope winch 11, which has a brake.

FIG. 3 is a perspective fragentary view showing mixing means 60, which are disposed in the mixing vessel 6. A bearing housing 61 is mounted on the bottom of the drum-shaped mixing vessel 6. The main drive shaft 8 is rotatably mounted in a bearing housing 61, which is mounted on the bottom of the drum-shaped mixing vessel 6. A spider 63 is connected by a hub 62 to the main drive shaft 8 mounted in the bearing housing 61. Preferably four mixing arms 64, 65, 66 and 67 are pivoted to the spider 63. A bucket 69, 70, 71 or 72 is mounted at the free end of each arm 64, 65, 66, 67, with a shock absorber interposed. An additional mixing bucket 73 is screw-connected to the spider 63. The bucket 69 is curved inwardly toward the hub 62. The buckets 70 and 71 are approximately vertical in the mixing vessel 6, and the bucket 72 is curved outwardly toward the inside peripheral surface of the mixing vessel 6 so that it presents a smaller resistance to the material which is to be mixed and circulated.

A working implement consisting of a rope winch 26 having no brake will be explained more fully with reference to FIGS. 4 and 5. A non-positive clutch 80 is associated with the working implement consisting of the rope winch 26 and comprises a drum-shaped housing 81. A rope-winding core 84 surrounds a central clutch shaft 82, with a hub 83 interposed. By suitable fixing means, such as screws, the hub 83 is secured to the clutch housing 81. The drum-shaped housing 81 forms a lateral confining surface 85, which protrudes radially beyond the rope-winding core 84. The second lateral confining surface 87 which protrudes radially beyond the rope-winding core 84 is formed by a flange 86, which is opposite to the lateral confining surface 85 and which is fixed to the rope-winding core 84 and the hub 83. On that side of the drum-shaped housing 81 which is remote from the lateral confining surface 85 associated with the rope-winding core 84, the housing 81 is provided with a plate 88, which carries a flange 89, which surrounds the clutch shaft 82 and is formed with tapped bores 90. The flange 89 is preferably welded at its inside surface to the clutch shaft 92. A control linkage 38 and an actuating element 39 are secured to the flange 86 on that side which is remote from the lateral boundary surface 87. A control rope 91 is connected by a thrust bearing 92 to the control linkage 38. The control rope 91 extends through the rope winch 26 and the drum-shaped housing 81 of the clutch 80 and actuates a coupling element 93 of the clutch 80.

FIG. 6 is a detailed view showing a working impement which consists of a rope winch 11 provided with a brake. The same reference characters are used for components which are identical or similar to components of the working implement shown in FIGS. 4 and 5. The rope-winding core consists of a ring 84. A brake 95 has a drum-shaped housing 96, which forms a lateral confining surface 87 that is opposite to the lateral confining surface 85 formed by the drum-shaped housing 81 of the clutch 80. The rope-winding ring 84 is screwed to the hub 83. The brake 95 is designed substantially like the clutch 80. Just as with the clutch 80, the drum-shaped housing 96 of the brake 95 is provided with a plate 97 on that side which is remote from the lateral confining surface 87. The corresponding plate of the clutch 80 is designated 88. A carrying plate 98 is disposed above the plate 97 of the brake 95 and jointly carries the control linkage 38 and the actuating element 39 for controlling the clutch as well as another control linkage 53 and an actuating element 54 for controlling the brake 95. A control rope 99 is connected to the control linkage 53 for controlling the brake 95. The other end of the control rope 99 is connected by a guide 100 to the brake 95. The brake 95 is mounted on the clutch shaft 82 with a bushing 101 interposed. The carrying plate 98 is secured to a hub 70, which is supported on the clutch shaft 82 by means of a bearing 102. A circlip is provided between the bearing 102 and the bushing 101.

FIG. 7 shows an arrangement comprising two working implements, which consist of rope winches 11 provided with a brake each. The two brakes are designated 95 and 95', and the two clutches are designated 80 and 80', for the sake of clearness. In FIG. 7, the same reference characters are used for components which are the same as those shown in FIGS. 4 to 6 and which are not explained in detail.

A chain sprocket 107 is provided between the brake 95' of one rope winch 11 and the clutch 80 of the other rope winch 11 and for a deflecting of drive forces can cooperate with a chain sprocket 107, which will be explained more fully with reference to FIG. 8.

FIG. 8 shows a speed-reducing transmission 109, which is coupled to a drive shaft 108. A chain sprocket 107 is mounted on the drive shaft 108 and may be used to drive by means of a power-transmitting chain, e.g., the chain sprocket 106 shown in FIG. 7. By means of a tapered roller bearing 111 the drive shaft 108 is rotatably mounted in a housing part 110. A first bevel gear 112 of the speed-reducing transmission 109 is disposed between the chain sprocket 107 and the tapered roller bearing 111 and is connected to the drive shaft 108 and in mesh with a second bevel gear 113, which is mounted on an output shaft 114 of the speed-reducing transmission 109. On that end of the output shaft 114 which is opposite to the second bevel gear 113, a V-belt pulley 115 is mounted, which serves to drive additional working implements which are not shown on the drawings.

With reference to FIGS. 1 to 8, the operation of a machine 1 for mixing building materials will now be described in more detail. That machine 1 for mixing building materials is an illustrative embodiment of the invention and comprises a prime mover 41, which may consist, e.g., of an internal combustion engine or an electric motor. When the prime mover 41 has been started, it drives the main drive shaft 8 so that the buckets 69 to 72 carried by the arms 64 to 67 of the mixing means 60 revolve, e.g., in a clockwise sense. When the buckets 69 to 72 strike on an obstacle as they revolve, they can yield and move past the obstacle because the shock absorbers 68 are provided.

Clutch shafts 82 as shown in FIGS. 4 to 6 are connected to the main drive shaft 8. Clutches 80, 80' and brakes 95, 95' are connected to the clutch shafts 82 and associated with working implements which consist of rope winches 11, 26. When the actuating elements 39, 54 and the control linkages 38, 53 are appropriately operated, the clutches 80, 80' are engaged so that the traction rope 28 is wound on the rope-winding core 84. If the traction rope 28 is connected, e.g., to the working implement consisting of the rope winch 26 having no brake, the charging bucket 30 will then move toward the mixing vessel 6 and will thus push material to the machine 1 for mixing building materials. The control elements may be actuated, e.g., by the switch 32 of the charging bucket 30 and a solenoid, not shown. In a similar manner, the clutches 80, 80' and possibly the brakes 95, 95' can be operated which are associated with the other working implements consisting of rope winches.

As a supplement to FIGS. 1 to 8, FIG. 9 shows as an alternative a separate prime mover 116 for the charging bucket 30 of FIGS. 1 and 2. The independent prime mover 116 may consist of an electric motor or an internal combustion engine. A working implement consisting of a rope winch 26 having no brake is disposed between a bearing 117 for the output shaft of the prime mover 116 and another bearing 118. A traction rope 28 is wound on the rope winch 26 and is secured at its free end 29 to the charging bucket 30. The control linkage 38 and the actuating element 39 are shown too. The independent prime mover 116 is mounted on a carrying plate 119, which carries also a line shaft 119*a*, which is spaced from the prime mover 116 and to which additional working implements can be connected in case of need.

With reference to FIGS. 10 and 11, another embodiment of a machine for use as a traction rope winch on a vehicle employed in forestry will now be described.

A main shaft 120 is connected to a power take-off shaft of an internal combustion engine, not shown, of the towing vehicle. A clutch 121 is mounted on the main shaft 120 and is coupled to a pinion 122, which is carried by a shaft 123 that is rotatably supported by two ball bearings 124, 125. A V-belt pulley 126 is mounted on the shaft 123 and preferably engages splines 127. A hub 128 is provided between a portion of the V-belt pulley 126 and the shaft 123. By the actuation of a lever 129, the V-belt pulley 126 can be coupled by the clutch 121 to the main shaft 120. The shaft 123 is mounted in a housing 92, which is connected by a bracket 130 to mounting and carrying flanges 131. A traction rope winch designated 133 in FIG. 11 is intended for use in forestry and comprises a main shaft 134 and a speed-reducing transmission 109, which is mounted on the central portion of the main shaft 134. The speed-reducing transmission 109 and the main shaft 134 are accommodated in a housing 135, which has end covers 136 and 137. A chain sprocket 139 is mounted in the housing 135 on the output shaft 114 of the speed-reducing transmission 109, with a bushing 138 interposed, and serves for connection to another working implement. The other parts of the speed-reducing transmission are designed and arranged as in the speed-reducing transmission described in detail with reference to FIG. 8. In FIG. 11, only about one-half of the length of the main shaft 134 is shown. Two working implements consisting of rope winches 140, 141 are connected to the main shaft 134 and are symmetrically disposed on opposite sides of the speed-reducing transmission 109. Each of these rope winches has a non-positive clutch 80, which comprises a drum-shaped housing 81 and to which a drum-winding core 84 is connected. The latter is supported by two double bearings 142, 143. The drum-shaped housing 81 of the clutch 80 forms a lateral confining surface 85, which protrudes radially beyond the rope-winding core 84. The opposite lateral confining surface 87 is formed by a flange 86. The control linkage 38 and the actuating element 39 are mounted on an additional carrying plate 144. In order to indicate that essential components of the traction rope winch 133 are identical with components of the rope winches used as working implements in the embodiments shown in FIGS. 1 to 9, identical or similar parts are designated by the same reference characters. As the mode of operation of the working implements and the clutches in conjunction with the main shaft is the same as in the embodiments shown in FIGS. 1 to 9, it is believed that this need not be described more fully.

What is claimed is:

1. A machine comprising a chassis, a carrying frame located on said chassis, a plurality of driven working implements supported on said carrying frame, at least one common main drive having a main drive shaft supported on said carrying frame, a connecting shaft non-rotatably connecting at least one of the working implements directly to the main drive shaft, at least one non-positive clutch associated with at least one of the respective working implements which cooperate with the connecting shaft to engage or disengage said working implement with said connecting shaft, and control means connected to said non-positive clutch for engaging and disengaging said working implement with said connecting shaft as desired.

2. A machine according to claim 1 wherein the main drive shaft is coupled to a speed-reducing transmission having an output shaft adapted to drive at least one of the working implements.

3. A machine according to claims 1 or 2, wherein a V-belt pulley adapted for connection to one of the working implements is mounted on the main drive shaft and/or on the output shaft of the speed-reducing transmission.

4. A machine according to claims 1 or 2, wherein a chain sprocket is mounted on the main drive shaft and/or on the output shaft of the speed-reducing transmission and is adapted for driving one of the driving working implements.

5. A machine according to claim 1 wherein the control means is a control rope.

6. A machine according to claim 5, wherein the control rope cooperates with a control linkage.

7. A machine according to claim 3, wherein at least one of the working implements is a rope winch.

8. A machine according to claim 1, wherein the non-positive clutch comprises a drum-shaped housing, which forms a lateral confining surface, which protrudes radially beyond a rope-winding core, which is mounted on a hub, which is mounted on the connecting shaft, and the latter is fixed to the drum-shaped housing of the non-positive clutch and to the hub and the rope-winding core.

9. A machine according to claim 8, wherein a flange forms a second lateral confining surface which protrudes radially beyond the rope-winding core.

10. A machine according to claim 8, wherein a second lateral confining surface, which is opposite to the first confining surface and radially protrudes beyond the rope-winding core is formed by a drum-shaped housing, which accommodates a brake for the rope winch, and the rope-winding core consists of an annular member that is disposed between and secured to the two drum-shaped housings.

11. A machine according to claim 10, wherein a second control rope is connected to the brake and cooperates with a second control linkage.

12. A machine according to claims 6 or 11, wherein the control linkages are mounted on a common carrying plate, which is secured to one of the two drum-shaped housings.

13. A machine according to claim 12, wherein the control linkages are adapted to be actuated manually and/or mechanically and/or electrically.

14. A machine according to claim 7, wherein the rope winch is a traction rope winch for use in forestry.

15. A machine according to claim 7, wherein two rope winches are connected to the main drive shaft on opposite sides of the speed-reducing transmission.

16. A machine according to claim 7, wherein the rope winch serves to operate a charging bucket, which is connected to a traction rope, which is trained over guiding and deflecting rope pulleys.

17. A machine according to claim 16, wherein a separate drive is provided for the rope winch and has an output shaft adapted for connection to one of the working implements.

18. A machine according to claim 7, wherein the rope winch is a drive means for a second machine for mixing building materials.

19. A machine according to claim 18, wherein the second machine comprises an elevator which is disposed in a shaft and has a traction rope trained over pulleys for guiding and deflecting the rope.

20. A machine according to claim 18, wherein the drive means comprises a slewing crane having a load-carrying container which is connected to a traction rope which extends to the rope winch over guiding and deflecting rope pulleys.

21. A machine according to claim 18, wherein the second machine for mixing building materials is driven by the output shaft of the speed-reducing transmission.

22. A machine according to claim 18, wherein the second machine for mixing building material is driven by the main drive shaft.

23. A machine according to claim 1, wherein the main drive shaft is vertical on the carrying frame.

24. A machine according to claim 19, wherein the rope winch for operating the elevator in the shaft is disposed over a mixing vessel, and a second rope winch for operating a charging bucket is disposed under the mixing vessel and both rope winches are axially aligned with the main drive shaft.

25. A machine according to claim 16, wherein the rope winch for operating the charging bucket is disposed over a mixing vessel, and a second rope winch for operating a slewing crane is disposed under the mixing vessel and both rope winches are axially aligned with the main drive shaft.

26. A machine according to claim 1, wherein said common main drive comprises an internal combustion engine.

27. A machine according to claim 1, wherein said common main drive comprises an electric motor.

28. A machine according to claim 1, wherein said non-positive clutch is a friction clutch.

* * * * *